US005653043A

United States Patent [19]

Bestwick et al.

[11] Patent Number: 5,653,043

[45] Date of Patent: Aug. 5, 1997

[54] BATCH CROP DRYER AND METHOD OF BATCH CROP DRYING

[75] Inventors: Ronald Bestwick, Taylorville; Jeffrey D. Decker, Lerna, both of Ill.

[73] Assignee: The GSI Group, Inc., Assumption, Ill.

[21] Appl. No.: 637,832

[22] Filed: Apr. 25, 1996

[51] Int. Cl.[6] ..... F26B 17/12

[52] U.S. Cl. ..... 34/171; 34/174; 34/507

[58] Field of Search ..... 34/168, 169, 171, 34/174, 175, 86, 65, 505, 507

[56] References Cited

U.S. PATENT DOCUMENTS

| | | | |
|---|---|---|---|
| 410,085 | 8/1889 | Gent . | |
| 1,102,714 | 7/1914 | Bornmann | 34/168 |
| 2,469,424 | 5/1949 | Wood et al. . | |
| 2,766,534 | 10/1956 | Schaub et al. | 34/505 |
| 2,941,310 | 6/1960 | Schaub | 34/65 |
| 3,416,239 | 12/1968 | Louks . | |
| 3,479,748 | 11/1969 | Sietmann . | |
| 3,943,636 | 3/1976 | Sietmann et al. . | |
| 4,242,806 | 1/1981 | McClaren | 34/13 |

*Primary Examiner*—Henry A. Bennett
*Assistant Examiner*—Dinnatia Doster
*Attorney, Agent, or Firm*—Polster, Lieder, Woodruff & Lucchesi

[57] ABSTRACT

Apparatus of the present invention for batch drying crop in the shell comprises a bin having a generally cylindric bin wall, a conical upper drying floor carded by the bin wall, means floor for forming a substantially uniform layer of the crop to be dried on the upper surface of the upper drying floor, and selectively operable means for effecting the gravity discharge of the batch of crop from the upper drying floor. An inverted conical lower drying floor is carded by the bin below the upper drying floor for receiving the crop discharged from the upper drying floor. The lower drying floor has a hopper shaped crop supporting surface. Means is associated with the lower drying floor for forming a substantially uniform layer of crop on the lower drying floor upon the crop being gravity discharged from the upper drying floor. The lower drying floor further has a bottom outlet for the gravity discharge of the crop supported thereon. The upper and lower drying floors are of perforate construction so as to permit air under pressure to flow therethrough and through the layer of crop supported thereon. A lower plenum is provided within the bin below the lower floor, and an upper plenum is disposed between the upper and the lower drying floors. A lower fan/heater forces air under pressure into the lower plenum so that air from within the lower plenum flows through the perforate lower drying floor and through the peanut layer carried thereby and into the upper plenum. An upper fan/heater forces heated air into the upper plenum such that the heated air from the upper fan mixes with the air forced through the crop on the lower drying floor such that air from both the lower fan/heater and the upper fan/heater is forced through the upper drying floor and the layer of crop thereon so as to at least in part dry the crop on the upper floor. A method of batch drying a crop is also described.

15 Claims, 7 Drawing Sheets

INNER LEVELING BAND

OUTER LEVELING BAND

DRYER EMPTY-READY TO RECEIVE GRAIN.

UPPER CHAMBER FULL-BRGIN DRYING.

AFTER DRYING, STEEP CYCLE BEGINS. NO FANS OR HEAT.

AFTER STEEP CYCLE, SECOND DRYING CYCLE.

DRIED GRAIN FROM TOP CHAMBER DUMPED IN BOTTOM CHAMBER. WET GRAIN IN UPPER CHAMBER.

IF TEMPERATURE EXCEEDS SET POINT, STEEP CYCLE CONTINUES.

STEEP CYCLE BEGINS AFTER FIRST DRY CYCLE.

SECOND DRY CYCLE. DRYER STOPS IF TEMPERATURE EXCEEDS SET POINT.

AFTER SECOND DRY CYCLE, DRIED GRAIN IN LOWER CHAMBER IS REMOVED, GRAIN FROM UPPER CHAMBER DUMPED INTO LOWER CHAMBER, UPPER CHAMBER FILLED WITH WET GRAIN, AND STEPS OF FIGS. 7f-7i REPEATED.

BATCH CROP DRYER AND METHOD OF BATCH CROP DRYING

BACKGROUND OF THE INVENTION

This invention relates to apparatus for and a method of batch drying various crops. This invention is particularly concerned with batch drying specialty crops, such as peanuts, rice and edible beans.

In the case of drying peanuts, special problems are presented. First, it will be recognized that peanuts are contained within a shell and the shell and the peanuts therein must be dried. Further, with the peanuts in the shell, the flowability of the peanuts is markedly less than the flowability of other crops, such as shelled corn, soybeans, milo, and the like. Presently, peanuts are dried in wagons brought to a drying facility with the peanuts remaining in the wagons while they are dried. The drying wagons have a perforate drying floor on which the wet peanuts are loaded and a plenum beneath the drying floor. A fan/heater is adapted to be connected to the plenum for introducing heated air into the plenum such that the heated air will be forced upwardly though the perforate floor of the wagon and into the peanuts loaded in the wagon. After the peanuts are dried, the peanuts are dumped from the wagons for storage.

Batch grain drying systems, such as are shown in U.S. Pat. Nos. 3,479,748 and 3,943,636 are known in which wet grain to be dried is conveyed to the top of a drying bin and discharged into a center opening in the peak of the bin roof. As best shown in U.S. Pat. No. 3,943,636, a sloped, perforated drying floor is provided in the upper portion of the bin beneath the bin roof. As the grain is discharged into the bin at the top thereof, the grain flows down sloped drying floor and forms a uniform layer thereon. A heater fan blows heated air into the bin below the sloped drying floor and the heated air, under pressure flows through the perforated drying floor and through the layer of grain supported thereon to dry the grain. Trap doors are provided around the lower outer margins of the sloped drying floor such that when the trap doors are opened, the batch of grain on the sloped drying floor is discharged by gravity via the trap doors into the bin below the drying floor. The lower portion of the bin has a raised, horizontal floor made of perforated floor members. Air from another blower is forced beneath the horizontal floor to pass through the floor and into the grain supported thereon to cool and further condition the grain dried on the sloped drying floor.

Other drying processes, such as shown in U.S. Pat. No. 2,469,424, are known in which wet grain to be dried is loaded into a hopper at the top of a tower. The wet grain is continuously discharged from the hopper onto a first sloped drying floor which has a slope approximately of the angle of repose of the wet grain being dried. The grain flows continuously down the first drying floor and is continuously discharged from openings around the outer margins of the first drying floor and is received on the upper reaches of a second drying floor therebelow. The second drying floor slopes inwardly and downwardly toward the center of the tower and the grain is received on the upwardly facing surface of this second or inverted drying floor. The grain flows down the second drying floor and is discharged from a center bottom opening onto the outer surface a third sloped drying floor. The grain then continuously flows by gravity down the outer surface of this third drying floor and then onto the inner surface of a fourth drying floor therebelow. The fourth drying floor is an inverted sloped floor and the grain is received on the inner face thereof. The slope of the third and the fourth drying floors are less steep than the slope of the first and second drying floors because the partially dried grain flowing down the third and fourth drying floors has a somewhat different angle of repose than the wet grain flowing down the first and second drying floors. This continuous dryer has a partition which divides the third and fourth drying floors. The space below the partition is in communication with a cold air duct which draws a partial vacuum within the space below the partition and above the fourth drying floor so that ambient air from the bottom portion of the dryer is drawn through the air previous fourth drying floor and through the grain flowing down the inner face thereof.

However, there has been a long-standing need to batch dry specialty crops, such as peanuts, in a manner that does not require the use of wagons during the drying process.

SUMMARY OF THE INVENTION

Among the provisions of the present invention may be noted the provision of such a specialty dryer in which a first batch of the crop may be dried on a first drying floor, unloaded to a second drying floor, and in which heat is recovered from the crop supported on the second drying floor so as to aid in the drying a second batch of grain on the first drying floor;

The provision of such a dryer in which the crop to be dried thereon is at least partially dried on a first drying floor, and then the first batch of grain is transferred to a second drying floor with heat being recovered from the grain on the second drying floor so as to aid in drying a batch of wet crop supported on the first drying floor;

The provision of a method of drying specialty crops, such as peanuts, in which a first batch of the crop is dried by forcing heated air is forced through the first batch, dumping the first batch, recovering heat from the first batch and using the recovered heat to in part heat and dry a second batch;

The provision of such a batch drying method and apparatus which does not require the use of drying wagons for drying peanuts and other specialty crops;

The provision of such a drying method and apparatus in which dried grain is removed from the dryer by gravity flow; and The provision of such a drying system and method which is economical to manufacture and construct, which handles specialty crops with very different flow characteristics, which in economical in operation, and which is reliable in operation.

Briefly stated, apparatus of the present invention is for batch drying granular crops (e.g., peanuts, rice, corn, milo, wheat, soybeans and the like) in a bin. The bin has a generally cylindric wall, a generally conical shaped roof on the upper end of the bin wall enclosing the bin, a bin floor for the bin at the bottom of the bin, and a first drying floor mounted within the bin below the roof for receiving a batch of the crop to be dried. The first floor is generally conical in shape and slopes downwardly and outwardly toward the cylindric bin wall. A plurality of dump openings are provided in the first drying floor spaced around the outer margins thereof adjacent the cylindric wall. Means is provided for selectively opening the dump openings for the gravity discharge the crop batch from the first drying floor readying the first drying floor to receive a second crop batch to be dried. A second drying floor is positioned within the bin below the first drying floor and above the bin floor. The second drying floor is generally of inverted conical shape and has its outer margin secured to the bin wall below where the outer margins of the first drying floor are attached to the bin wall. The second drying floor has a crop supporting surface sloping downwardly from the bin wall and inwardly toward the bottom of the second floor at the center of the second floor. The second floor has a bottom outlet at the lower center thereof and the second drying floor is adapted to receive the crop batch discharged from the first drying floor via the dump openings with the first crop batch being supported on the upper face of the second drying floor. Both the first and second drying floors are of perforate construction for the passage of air therethrough. The space between the bin floor and the second drying floor constitutes a first plenum and the space between the first and second drying floors constitutes a second plenum. A first blower introduces air under pressure into the first plenum for forcing air from the first plenum through the second drying floor and through the first crop batch supported thereon so as to at least in part recover heat from the first crop batch and to at least in part further condition the first crop batch and to discharge the air from the first plenum into the second plenum. A second fan is provided for forcing air into the second plenum such that air from within the second plenum is forced upwardly through the first drying floor and through the second crop batch on the first drying floor and thence to be discharged from the bin.

Alternatively stated, apparatus of the present invention for batch drying peanuts in the shell comprises a bin having a generally cylindric bin wall, a conical upper drying floor carded by the bin wall, means for forming a substantially uniform layer of the peanuts to be dried on the upper surface of the upper drying floor, and selectively operable means for effecting the gravity discharge of the batch of peanuts from the upper drying floor. An inverted conical lower drying floor is carded by the bin below the upper drying floor for receiving the peanuts discharged from the upper drying floor. The lower drying floor has a conical hopper shaped crop supporting surface. Means is associated with the lower drying floor for forming a substantially uniform layer of peanuts on the lower drying floor upon the peanuts being gravity discharged from the upper drying floor. The lower drying floor further has a bottom outlet for the gravity discharge of the peanuts supported thereon. The upper and lower drying floors are of perforate construction so as to permit air under pressure to flow therethrough and through the layer of peanuts supported thereon. A lower plenum is provided within the bin below the lower floor, and an upper plenum is disposed between the upper and the lower drying floors. A lower fan/heater forces heated (or ambient) air under pressure into the lower plenum so that air from within the lower plenum flows through the perforate lower drying floor and through the peanut layer carried thereby and into the upper plenum. An upper fan/heater forces heated air into the upper plenum such that the heated air from the upper fan mixes with the air forced through the peanuts on the lower drying floor such that air from both the lower fan/heater and the upper fan/heater is forced through the upper drying floor and the layer of peanuts thereon so as to at least in part dry the peanuts on the upper floor.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
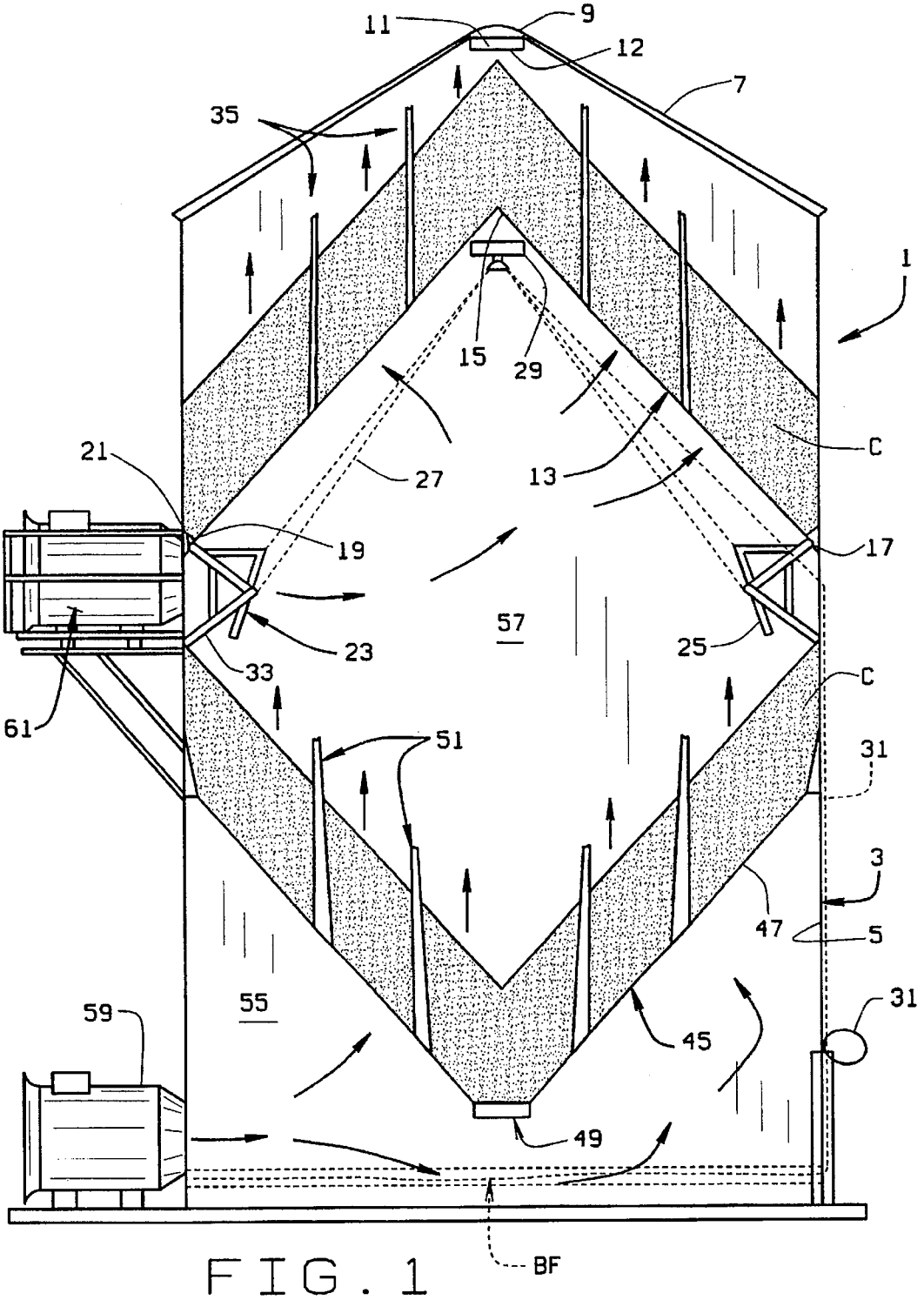
FIG. 1 is a cross sectional view of a batch bin dryer of the present invention having a first or upper sloped drying perforated floor for supporting a first crop batch in a layer in a substantially uniform depth to have heated air circulated therethrough by a fan/heater and a lower drying floor having an inverted conical shape for receiving the first crop batch from upper drying floor with the crop batch on the second floor being of a substantially uniform depth with air from a second fan/heater being forced through the second drying floor and through the crop batch on the second drying floor for conditioning this crop batch and for recovering at least a portion of the heat from the crop on the lower floor so as to aid in heating and drying the crop batch on the first drying floor.

Referring now to the drawings, and particularly to FIG. 1, a batch type crop dryer of the present invention is generally indicated in its entirety by reference character 1. Crop dryer 1 is shown to comprise a generally cylindrical sheet metal grain bin, as indicated at 3 having a cylindrical bin wall 5 and a conical shaped bin roof 7. Within the broader aspects of this invention, bin 3 may be of any desired diameter and height. For example, the bin may be 24 ft. in diameter and have a bin wall height of approximately 33 ft. The conical bin roof 7 is shown to have a slope of about 30°. The bin roof has a roof peak 9 at the upper extremity thereof and a center roof opening 11 is provided at the roof peak for the introduction of the crop to be dried into the drying bin by means of a suitable conveyor or the like (not shown).

In accordance with this invention, a first or upper sloped conical shaped drying floor, as generally indicated at 13, is rigidly affixed to the inside surfaces of bin wall 3 below the caves between bin wall 3 and bin roof 7 in such manner as to support the first floor and a layer (or batch) of the crop to be dried supported thereon. It will be understood that the metal channels comprising drying floor 13 is formed from a series of side-by-side perforated channel members extending along the conical surface of the drying floor from the caves to the peak thereof. Preferably, these drying floor members are perforated for the passage of air there through but where the perforations are sufficiently small as to retain the crop to be dried thereon. Those skilled in the art will recognize that there are numerous construction for the drying floors that allow the passage of drying air therethrough, but the construction preferred is to form the drying floor members of perforated sheet metal. The size and spacing of the holes will depend on the crop being dried.

As shown, the slope of drying floor 13 is similar to the angle of repose of the crops to be dried so that the crop will form a layer of substantially uniform thickness on the drying floor. As shown, the slope of the upper drying floor 13 is approximately 45°, but the slope of the bin floor may vary considerably, depending on the crop to be dried. Generally the angle of the slope of upper drying floor 13 is desirably somewhat greater than the angle of repose of the crop such that the crop will, when desired, flow by gravity down the slope drying floor 13. As indicated at 15, drying floor 13 has its peak centered within the bin and disposed generally below roof opening 11 such that as a crop is discharged into the interior of the bin via the roof opening 11, the crop will first encounter drying floor peak 15 such that the crop will be uniformly distributed around the circumference of drying floor 13. As indicated at 17, the outer margins of drying floor 13 are secured to bin wall 5 so as to support the first floor and the weight of the crop batch deposited thereon.

Further in accordance with this invention, a plurality of discharge openings 19 are provided in drying floor 13 around the outer margin of the floor adjacent the attachment 17 of the drying floor to bin wall 5 such that the crop C supported on the drying floor may flow by gravity down the slope of the drying floor and be discharged into the interior of the bin via the discharge openings. The number of discharge openings 19 may vary considerably, depending on the diameter of bin 3 and the crop to be dried. For example, for a 24 ft. diameter bin 3 approximately 24–36 of discharge openings 19 may be provided. These openings are sufficiently close together so as to form a substantially continuous discharge opening around the lower margin of the drying floor such that all of the crop supported on the drying floor may be readily gravity discharged from the first drying floor. As indicated at 21, flashing extends between the outer margin of the first floor below the outlets 21 to the bin wall 5 above the junction between the drying floor and the bin wall so as to ensure that all of the crop batch is discharged from the openings 19 and such that pockets of the crop are not trapped adjacent the outer margins of the drying floor.

It will be appreciated that especially for crops such as peanuts which do not exhibit good flowability properties that ideally a continuous discharge opening extending substantially continuously around the lower margin of the upper drying floor 13 would be preferred to as to lessen the tendency for the crop to bridge and not gravity discharge from the upper floor. It will be further appreciated that the term "plurality of outlet openings", as used in this specification may mean many smaller openings spaced around the lower margin of the upper drying floor or fewer, but larger openings, or even an single opening. What is important within the meaning of this invention is that the openings and discharge mechanisms be such as to enable the complete gravity discharge of the crop batch from the upper drying floor when desired.

As generally indicated at 23, selectively operable chutes or other opening means is provided so as to open openings 19 for the gravity discharge of the crop batch supported on first drying floor 13. The selectively operable discharge opening means may comprise dump chutes 25 associated with each of the discharge openings 19 with the dump chutes being operable substantially simultaneously by means of a cable and pulley wench system, such as shown in U.S. Pat. No. 3,943,636 (which is herein incorporated by reference, and which is well known to those skilled in the art) to effect the gravity discharge of the crop batch from the first drying floor.

Figure 5:
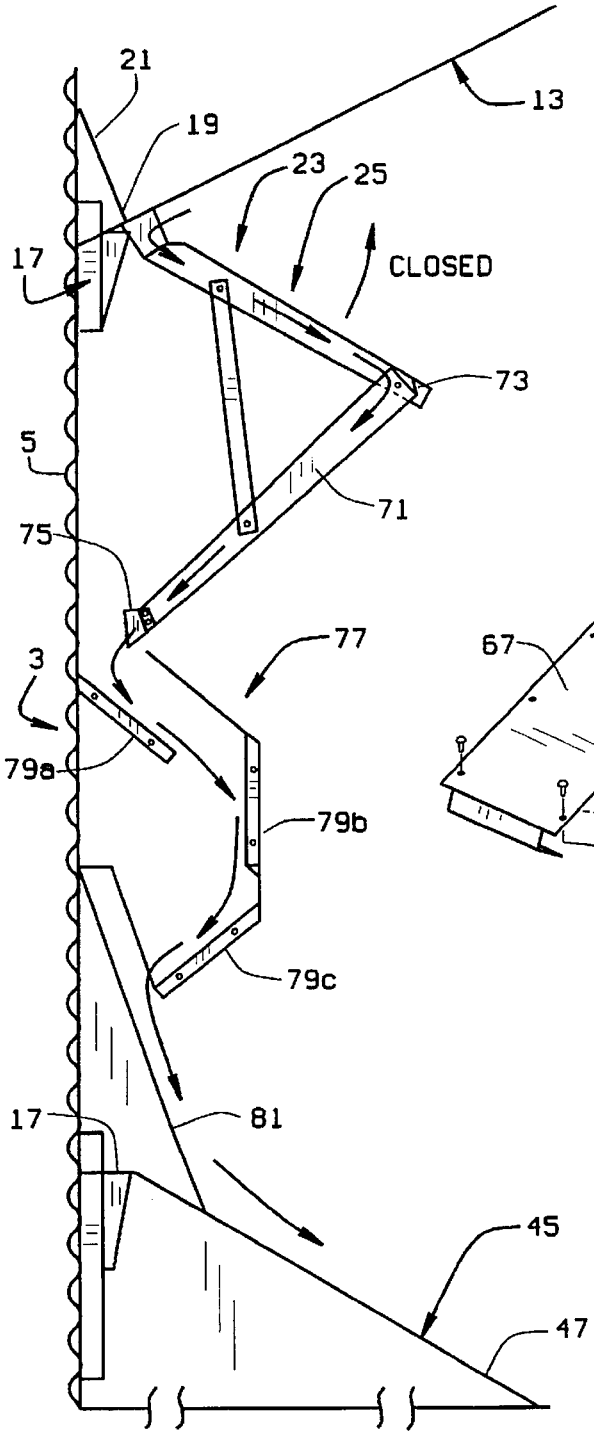
FIG. 5 is an enlarged sectional view of a portion of the side wall of the bin illustrating a discharge chute arrangement for the gravity flow of the crop batch initially supported on the upper drying floor to the lower drying floor with flow directing baffles being provided so as to direct or channel the flowing crop onto the upper reaches of the lower drying floor substantially without damage to the flowing crop.

More particularly, the gravity discharge outlet means 23 comprises a plurality of chutes 25 moveable between a raised, closed position (as shown in solid lines in FIG. 1) in which openings 19 are closed so that the crop supported on drying floor 13 is prevented from flowing out of the discharge openings and a lowered, open position (as shown in the open solid lines of FIG. 1 and also as shown in FIG. 5) in which the crop in communication with the openings is gravity discharged down the chutes 25 for discharge into the interior of the bin for purposes will appear. Of course, as the crop immediately above openings 19 is discharged via the chute, the adjacent crop immediately there above supported on drying floor 13 will also flow downwardly into the chute and thus the entire crop layer C supported on drying floor 13 may be gravity discharged via openings 19 and chutes 23. As indicated at 27, chains are connected to chutes 25 and the chains 27 are connected to a center ting supported beneath floor peak 15. All of the chains 27 are operated simultaneously by means of a cable and winch arrangement, as generally indicated at 31, which may be selectively operable by an operator standing on the ground adjacent the bin wall thereby to simultaneously open and dose all of the chutes 25. Again, such dump mechanisms are well known to those skilled in the art and are commercially available in single floor batch grain drying apparatus such as shown in the above noted U.S. Pat. No. 3,943,636 or as are commercially available from the assignor of the present invention, Grain Systems Inc., of Assumption, Ill., under the trade designation Top Dry Grain Dryers.

Chutes 25, when open, are shown to direct the crop flowing there through to a diverter which allows the crop to gently flow downwardly toward the upper reaches of a lower sloped second drying floor, as will be hereinafter described.

Figure 2:
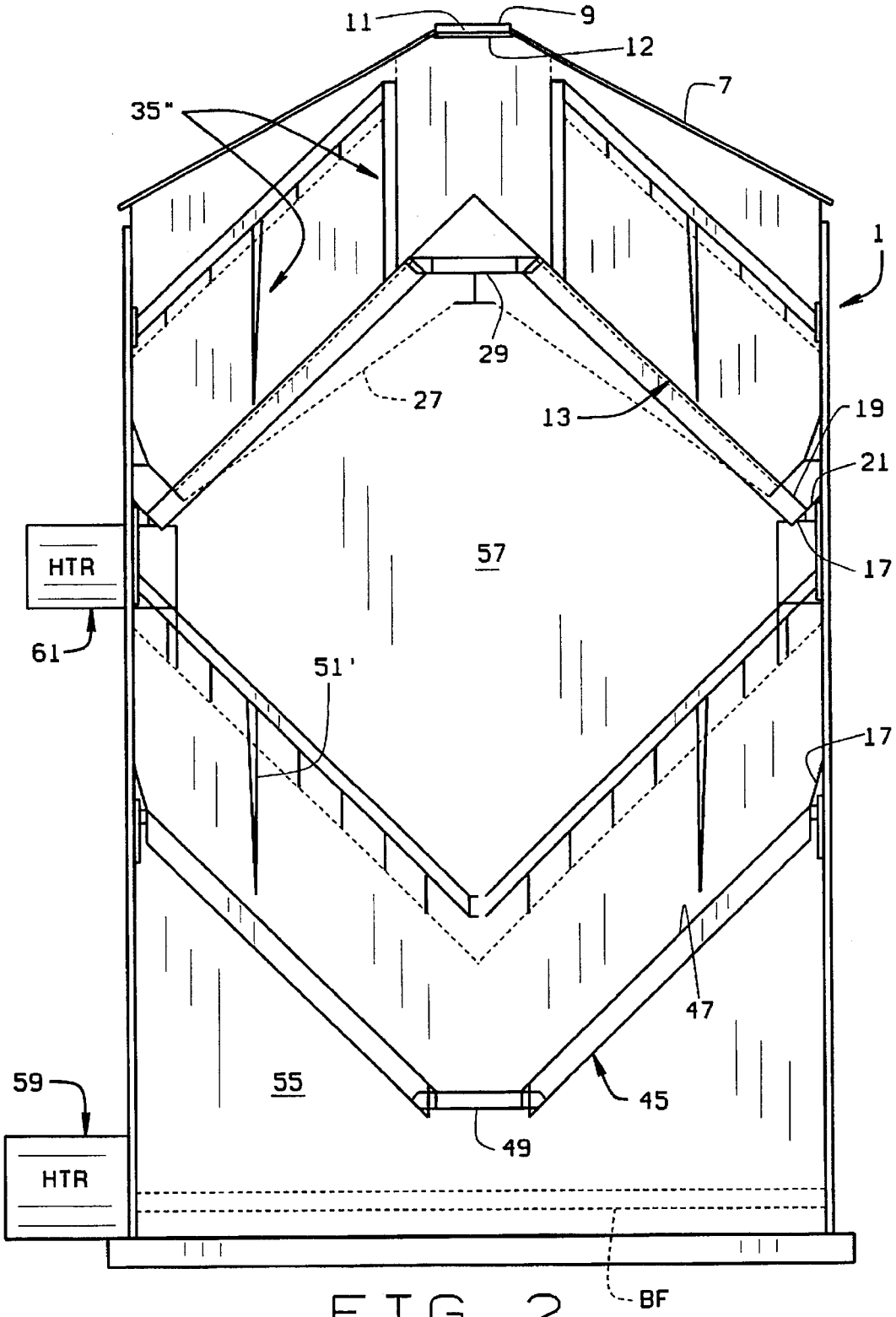
FIG. 2 is a view similar to FIG. 1 of another embodiment of the dryer of the present invention in which the leveling means for forming a layer or batch of the crop to be dried of substantially uniform depth on both the upper and lower conical drying floors are supported from above rather than being supported from the drying floors, as shown in FIG. 1.
Figure 3:
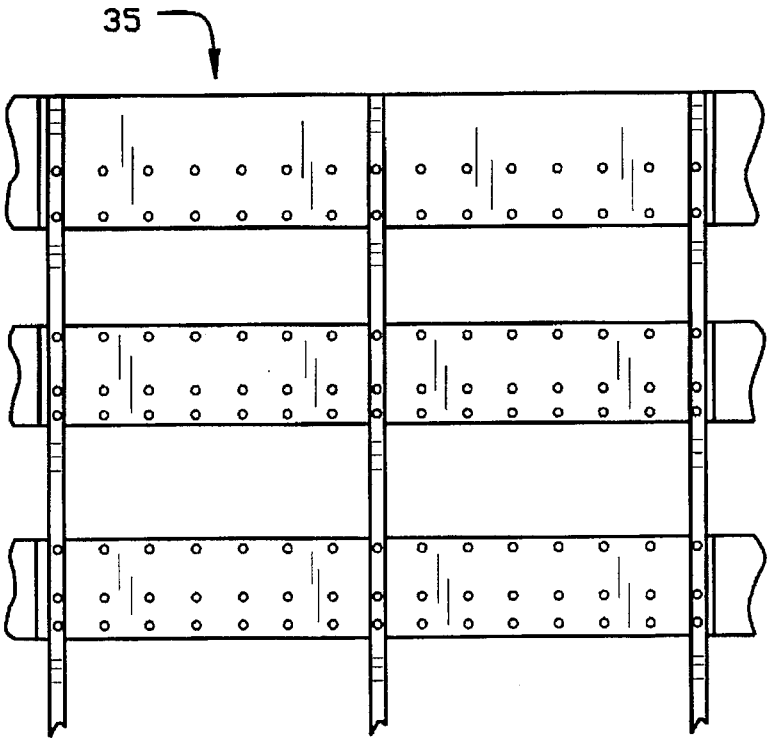
FIGS. 3 and 4 are elevational views of segments of the upper and lower leveling bands for the upper and lower drying floors, respectively.
Figure 4:
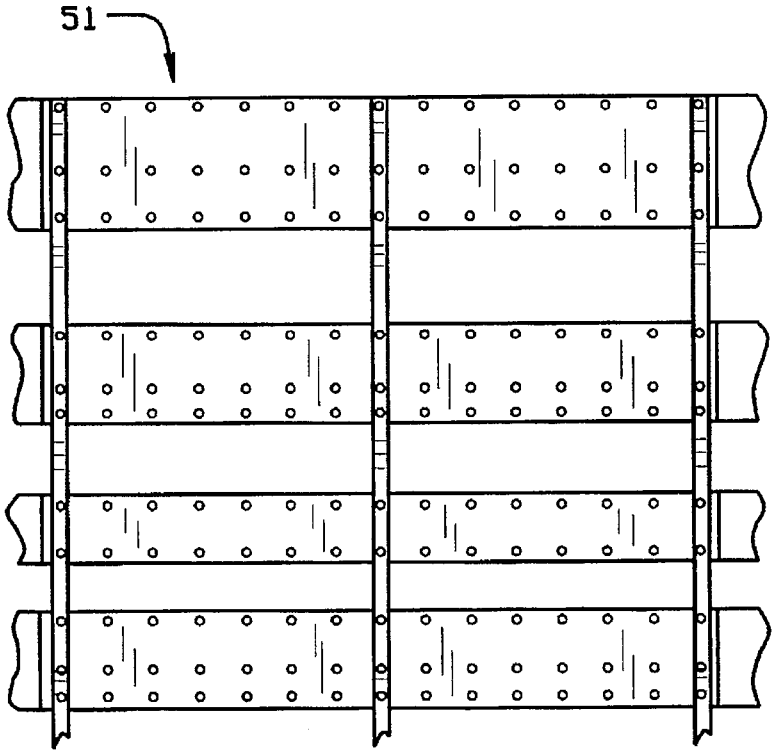

As shown in FIG. 1, drying floor 13 is provided with means, as generally indicated at 35, for providing a layer of the crop C to be of substantially uniform depth along the slope of drying floor 13 so that the crop supported thereon may be dried or conditioned uniformly along the slope of the drying floor. Leveling means 35 comprises a plurality of leveling rings (an inner ting and an outer ting are best illustrated in FIGS. 3 and 4) arranged generally concentrically on the first or upper drying floor and extending generally vertically with respect to the upper drying floor. These leveling bands may be either connected directly to the upper surface of the drying floor, as shown in FIG. 1, or may be suspended from an overhead structure 36, as shown in FIG. 2. The leveling bands may, as shown in FIGS. 3 and 4, be comprised of a series of solid bands of varying height, spaced vertically from one another with gaps there between. Typical leveling ring heights and spacings are shown for both the inner and the outer leveling bands for the upper and lower drying floors are shown in FIGS. 3 and 4.

It will be understood that as the crop is discharged into the upper portion of bin 3 via a conveyor auger or the like through center opening 11 in bin roof 7, the crop will flow down the upper portion of the slope drying floor 13 until it encounters the lower most leveling band of the inner leveling ring. This lower band will serve as a dam and the crop will build up thereon until it flows over the top of the lower most leveling band and through the gap between the lower most leveling band and the next vertically adjacent leveling band. As the crop overflows the first leveling band of the inner ring, the crop will again flow down the slope of the roof until it encounters the lower most leveling band of the lower ting where again it will build up until it overflows the first leveling ting and it continue down the slope of the roof until it encounters the bin wall. As grain is continued to be loaded into the bin and after a substantially uniform layer is formed between peak 15, the first leveling band of the first leveling ring, continues to flow down the slope to the lower most leveling band of the outer most ring and flows down to the bin wall, the next adjacent leveling band of the inner leveling band assembly will serve as a dam blocking further flow until it overflows and so forth until a layer of the crop is formed on the upper face of drying floor 13 of substantially uniform depth, as generally shown in FIG. 1. In this manner, it will be appreciated that air directed through drying floor 13 and through the crop will meet essentially uniform air resistance along the slope of the drawing floor such that all portions of the crop batch supported thereon receives essentially the same amount of air under the same drying conditions thereby to promote uniform drying and or conditioning of the crop batch supported on the first drying floor.

As shown in FIGS. 1 and 2, a second drying floor, as generally indicated at 45, is rigidly secured to the inner face of bin wall 5 below the attachment point 17 of the first drying floor 13 to the bin wall. However, the second drying floor 45 is of inverted conical shape thereby to form a hopper which receives the crop batch originally supported on the first drying floor. Floor 45 has an upper (inner) surface which supports the crop with this upper surface being sloped at a conical angle somewhat greater than the angle of repose of the crop to be dried therein. As indicated in FIG. 1, the slope of drying floor 45 is approximately 45°. The second drying floor 45 is provided with a bottom center discharge outlet, as generally indicated at 49, for the gravity discharge of the crop layer from this bottom center discharge opening. Further, the second drying floor is provided with leveling means 51, similar to the leveling means 35 described above in regard to the first drying floor, for ensuring the formation of a layer of substantially uniform depth of the crop batch to be further dried or conditioned on the second drying floor 45.

As perhaps best shown in FIG. 1, a first plenum or chamber, as indicated at 55, is provided within bin 3 below second drying floor 45. Further, a second, generally diamond shaped plenum, as indicated at 57, is formed by the bottom surface of the first or upper conical drying floor 13 and by the upwardly facing surface of the second or lower drying floor 45. A first heater/fan 59 unit is provided at the bottom of bin 3 for introducing either ambient or heated air under pressure into the first plenum 55 so as to force such air upwardly through the perforated second drying floor and through the layer of crop C2 supported on the second drying floor. The air percolates through the layer of crop supported on the second drying floor, it enters into the second plenum 57. As generally indicated at 61, a second heater/fan unit is mounted on the exterior of bin wall 3 so as to force heated or ambient air into the second plenum 57 to commingle with the air which has been forced through the crop layer on the lower or second floor 45 such that air from both of the fan units 59 and 61 is forced upwardly through the perforate first or upper floor 13 and through the crop layer thereon so as to heat and/or condition the crop layer supported on the first floor.

For example, fan 59 may be a 30 hp. 42" diameter fan, such as a series 2000 fan/heater commercially available from Grain Systems Inc., of Assumption, Ill. For such heater/fan units, the heater is typically a propane fired unit with a heat output ranging between about 3.5 million and about 10.25 million BTUs/hr., and have airflow rates of up to about 47,000 cfm at static pressures as low as about 0.5 inches of water, depending on the size of the dryer of the present invention and the throughput desired for the crop to be dried. Of course, as the air is discharged from the crop layer on the first or upper floor 13 into the upper reaches of the bin and beneath the bin roof, such air, which is now laden with moisture from the crop, is discharged from the bin via roof vents (not shown) as are typically used with grain bin dryers well known to those skilled in the art.

Figure 6:
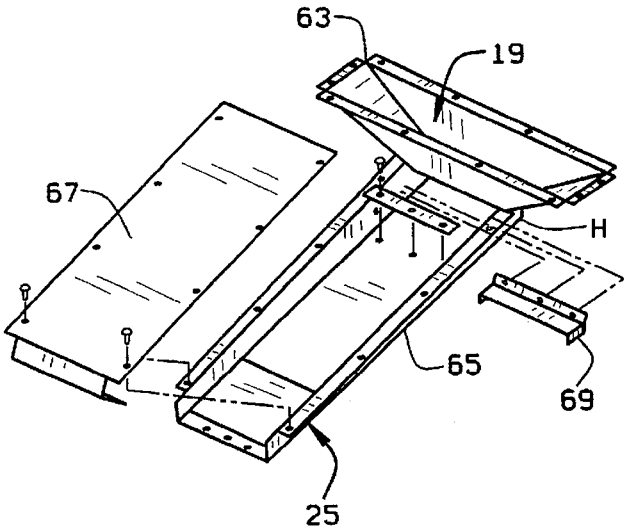
FIG. 6 is a perspective view of one of the discharge chutes which is hingedly connected to a funnel assembly associated with one of the discharge openings for the upper or first drying floor.
Figure 7A:
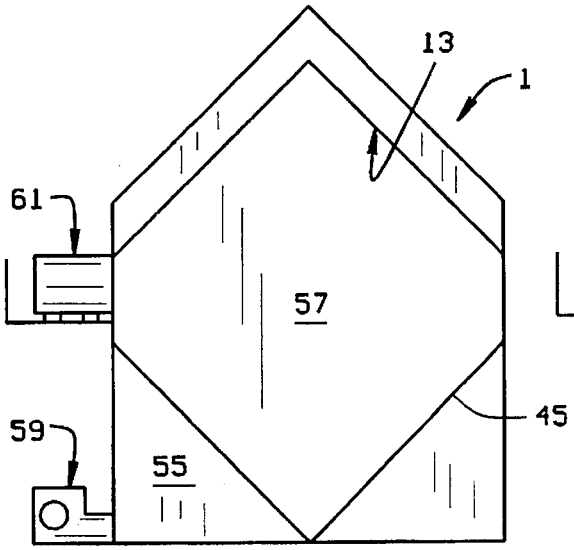
FIG. 7 is a diagrammatic block diagram illustrating the various steps of the crop drying method of the present invention using a batch crop dryer of the present invention.
Figure 7B:
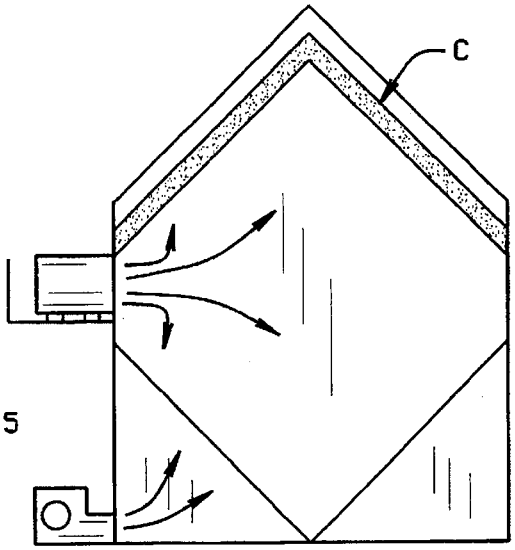
Figure 7C:
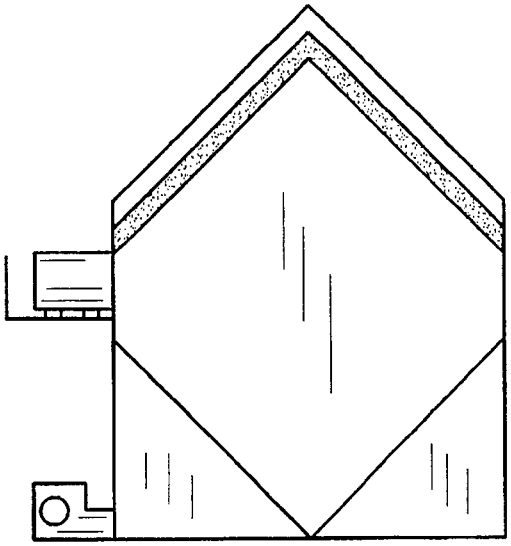
Figure 7D:
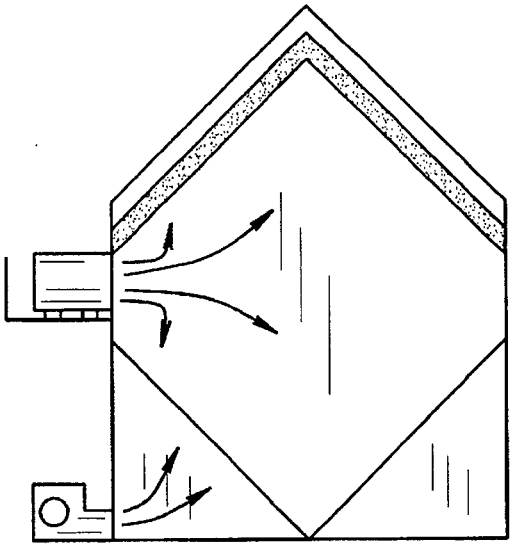
Figure 7E:
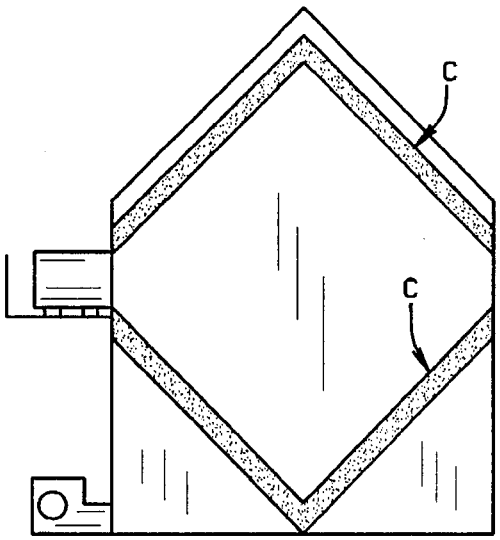
Figure 7F:
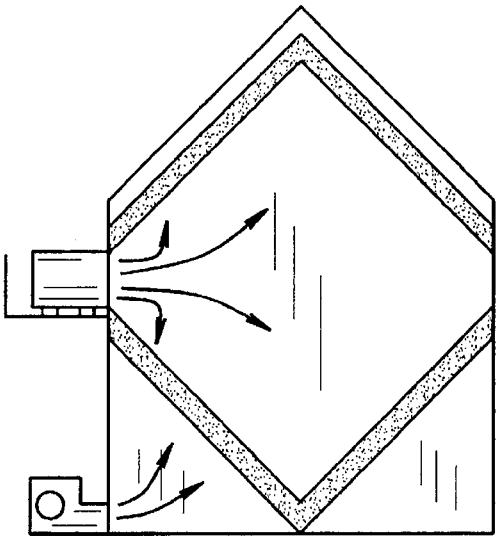
Figure 7G:
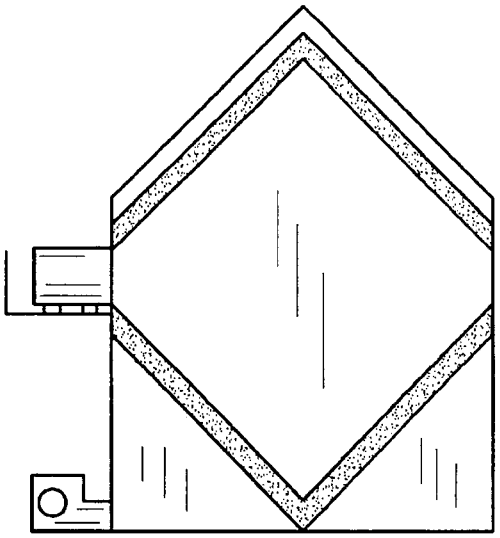
Figure 7H:
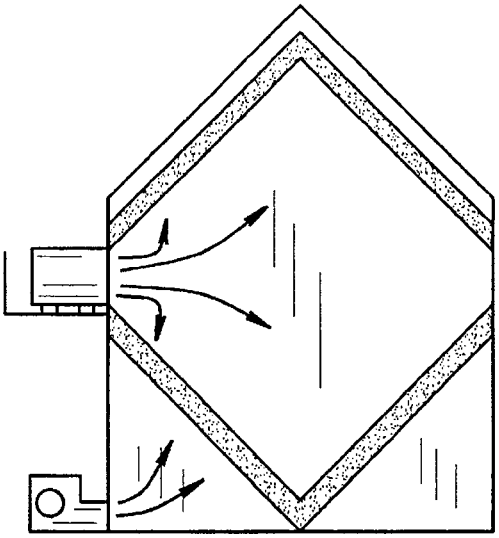
Figure 7I:
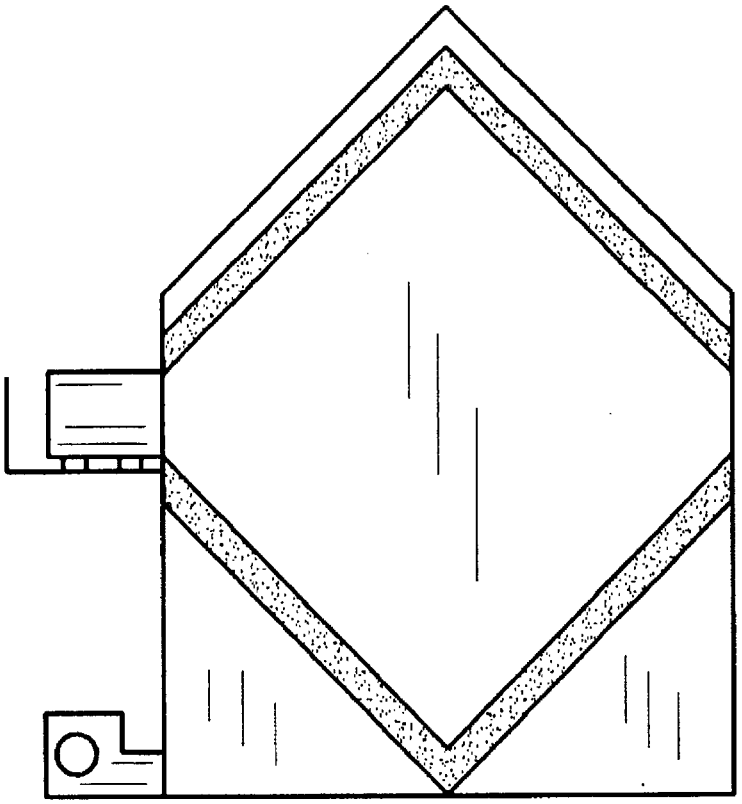

Referring now to FIG. 5, it will be noted that gravity discharge chute 25 is hingedly connected to the lower face of the upper drying floor 13 for movement between a lowered open position (as shown in FIG. 5) so as to permit the gravity flow of grain or the crop from a respective discharge outlet 19, and a raised closed position (not shown in FIG. 5, but illustrated in the solid dark lines in FIG. 1) so as to block the flow of grain or crops from the first drying floor. As shown in FIG. 6, chute 25 comprises a funnel assembly 63 secured to the bottom face of the first drying floor and register with one of the outlet openings 19 therein. This funnel assembly directs the grain flowing into the outlet 19 downwardly to the chute 25. More specifically, chute 25 comprises a channel shaped chute body 65 having a top cover 67. As indicated at 69, a valve member 69 is disposed in the upper end of the chute such that when the chute is in its raised retracted position, upon actuation of the winch and chain mechanism 31 heretofore described, valve member 69 blocks the flow of the crops or grain from flowing over top cover 67.

Further, a second chute 71 is secured to the outer end of chute 25 and chute 71 has a deflector plate 73 at its upper end which extends upwardly into the channel shaped chute 25 so as to intercept the crop or grain flowing down chute 25 and to direct it into chute 71. On the bottom end of the chute 71, a diffuser plate 73 deflects the flowing crop downwardly into a flow director assembly, as generally indicated at 77, for gently guiding the grain or crop so as to flow onto the upper reaches of the second drying floor 45 and thereby to aid in the uniform distribution of the crop on the second drying floor. This flow director assembly 77 is shown to comprise a plurality of angled flow director plates, as indicated at *79a–79c*, for channeling the flow of grain generally downwardly onto the sloped flashing 81 extending between the upper reaches of second drying floor 45 and the inner face of bin wall 5. It will be understood that the flow director assembly 77 is particularly advantageous in unloading specialty crops, such as edible beans, which are prone to damage during handling and which require gentle handling.

In operation for drying a specialty crop, such as edible beans, an auger conveyor (not shown) is utilized to convey the beans to center opening 11 at the peak 9 of bin roof 7. As the beans fall clear of the auger through center opening 11, they encounter peak 15 of the drying floor and are distributed in a relatively uniform crop layer, as shown in FIG. 1, on the upper conical face of the upper drying floor. The leveling means 35 serves to aid in forming a relatively uniform depth of the specialty crop on the upper drying floor. The heater fan units 59 and 61 are started so as to force heated air into plenums 55 and 57, respectively. The heated air within the lower plenum 55 flows through the perforate lower drying floor 45 into the second plenum 57. Of course, heated air from the second fan unit 61 is also forced into plenum 57 such that the air within the second plenum is uniformly distributed there within and exerts a substantially constant pressure on the lower surface of the first drying floor 13. Since there is a uniform depth of the crop on the upper face of the drying floor 13, substantially uniform rates of air percolation through the crop will be experienced such that the crop is substantially uniformly dry from the outer lower margins of drying floor 13 to its peak 15. As the heated air is forced through the crop layer on drying floor 13, it picks up moisture from the crop and the moisture laden air is discharged from bin 3 by way of roof vents (not shown) on bin roof 7 in a conventional manner.

When the crop layer on the upper floor 13 has been dried a desired mount (generally when drying or curing is about ⅔ complete), the crop layer on the upper floor is gravity dumped from the upper drying floor 13 to the lower drying floor 35. This dumping action is accomplished by an operator actuating the winch cable arrangement 31 so as to substantially simultaneously move all of the dump chutes 25 from their raised closed position (as shown in dark solid lines in FIG. 1) which block the flow the crop from the discharge openings 19 around the lower periphery of the first drying floor to their lowered open position, as shown in open solid lines in FIG. 1 and as shown in FIG. 5, so as to allow all of the crop layer disposed on the upper surface of the drying floor to flow downwardly through chute 25 and 71. As the crop is discharged from chute 71, it encounters the flow director 77 so as to provide a substantially uniform flow of the crop onto flashing 81 and onto the upper reaches of the second converging conical shaped drying floor 45 second drying floor so as to form a crop layer on the upper or inner face of the lower drying floor of substantially uniform depth, as shown in FIG. 1. Of course, the leveling bands 51 provided for the lower drying floor aid in forming this crop layer of uniform depth.

A second batch of the crop to be dried is then loaded onto the upper face of the upper drying floor 13 in the manner heretofore described. Again, both heater fan units 59 and 61 are operated so as to force heated air into plenums 55 and 57. However, the crop layer now received on the upper face of the second drying floor 45 will have already been heated to a relatively high temperature by the drying operation that it underwent just a few minutes earlier when it was the crop layer disposed from the upper drying floor. It will be appreciated that the first heater fan unit 59 may now be operated at a lower temperature or may not be operated at all such that the fan unit only is operable so as to force ambient air into plenum 55. As this lower temperature or ambient air is forced through the second or lower drying floor 45 into the crop layer thereon, this lower temperature or ambient air will pick up heat from the heated crop and will enter the second plenum 57. In this way, heat energy utilized to heat the crop layer on the first drying floor is recaptured or regenerated and is again utilized to aid in drying of the second crop batch now undergoing a drying operation on the upper drying floor 13.

It will be appreciated that by allowing the crop to undergo an initial drying phase on the upper drying floor 13, then transferring the heated crop from the upper drying floor 13 to the lower drying floor 45, and by totally mixing the contents of the batch as it flows from the upper to the lower drying floor and then by forcing still additional heated air and then cooling air through the crop on the lower drying floor that a nearly uniform end crop batch is achieved and that the batch is cooled while in the lower chamber. Different time/temperature profiles may be selected to complete the curing and drying cycle. After cooling of the crop batch on the lower floor 45 as completed, the lower drying floor may be emptied by opening the bottom center opening 49 and by directing the flow of grain from opening 49 into well known auger conveying or other gravity flow conveying means.

It will be appreciated that as the heated air is forced upwardly through the crop layer on upper drying floor 13, the lower most regions of the crop in close proximity to the drying floor will usually dry to a greater degree than the regions of the crop near the upper surface of the drying layer. It will be appreciated that the leveling bands allow the upper most portions of the crop to be dumped from the upper drying floor 13 onto the lower drying floor 45 before the regions of the crop in close proximity to drying floor 13 are gravity emptied therefrom. This inverts the partially dried crop and produces a more uniform moisture content throughout the batch at the end of the drying cycle.

It will also be appreciated that as air is forced upwardly through the crop layers supported on the upper or the lower drying floors 13, 45, respectively, the air flowing through the perforate floors and flowing through the crop layer may, at least in part, fluidize the crop to as to enhance the tendency of the crop to flow by gravity down the slope of the drying floor for discharge in the manner heretofore described. It will be further appreciated that with certain crops which do not have good flowability characteristics, such as peanuts in the shell, even partial fluidization would enhance the ability of the dryer of the present invention to insure the gravity flow of the crop from the sloped drying floors in the manner heretofore described. By at least in part fluidizing the crop in the crop layers on the drying floors, the effective angle of repose may be lowered so as to insure that the crop will flow down the slope of the drying floors 13 and 45 with less tendency to become jammed by the leveling tings and with less tendency to jam or to bridge.

It will be further appreciated that the center outlet 49 for the lower drying floor 45 may be provided with a slide gate (not shown) to open and close the outlet and to control the flow of the crop from the lower dryer floor. It will also be understood that a variety of conventional conveying devices (e.g., auger conveyors, belt conveyors or the like) may be disposed below outlet 49 for conveying the crop from dryer 1 after it has been discharged from the lower drying floor. It will also be understood that the lower section of dryer 1 may be provided with an raised, perforate bin floor BF onto which the crop is discharged from outlet 49 and that ambient or conditioned air may be blown under pressure beneath the bottom bin floor and through the layer of the crop deposited thereon to further condition the crop discharged from the lower drying floor 45. Still further, it will be appreciated that the various openings through the bin wall 5 may be provided with dampers or other means (not shown) for controlling the flow of air into and out of bin 3 during operation of fan/heaters 59 and 61 so as to insure that air flows through the crop layers on drying floors 45 and 13 in the desired manners, as described above.

As described herein, bin 3 is shown to be cylindrical and the drying floors 13 and 45 are described as being conical in shape. However, within the broader aspects of this invention and as will be apparent to those skilled in the art, bin 3 may be of a cross-section other than circular (e.g., it may be polygonal) and the drying floors need not be conical so long as they slope in the manner herein described.

Referring now to FIG. 7, the steps involved in the method of drying batches of a crop C of is present invention, as described above are shown and described in greater detail. In FIG. 7*a*, the dryer 1 of the present invention is shown in an empty condition ready to receive a batch of crop C via roof opening 11. As shown in FIG. 7*b*, a batch of crop C has been loaded in the bin from above such that the batch is supported on the upper face of the upper, sloped drying floor 13 with the crop being distributed in a substantially uniform depth by the leveling bands 35. The upper fan/heater unit 61 is operated to force heated air under pressure into the upper plenum 57 such that the heated air is forced through the perforated upper drying floor 13 and through the layer of crop C on the upper floor. Of course, as the heated air comes into contact with and flows through the crop layer, it will pick up moisture from the crop and effect drying of the crop. Moisture laden air is discharged to the atmosphere via roof vents or the like (not shown). During this initial drying phase, the temperature of the air within plenum 57 may, for example, be controlled to be about 140° F.

After the crop layer on the upper floor 13 is partially dried or cured (i.e., after about 2/3 of the moisture is removed from the crop), the upper and lower fan/heaters 59, 61 may turned off and the crop on the upper floor is allowed to steep or sleep for a limited period of time (which will depend on the crop, its initial moisture content, the amount of moisture to be removed, and the depth of the crop layer on the upper floor). This steep or sleep cycle is typically for a preset time interval and the steep cycle allows the moisture in the crop to migrate toward the surface of the crop kernels so that in subsequent drying operations the moisture may be more readily removed. It should be noted that within the broader aspects of this invention, such a steep cycle is optional and may not be used with all crops being dried.

After the timer has timed out the steep cycle, the upper fan/heater unit 61 is again operated to force heated air through the upper drying floor 13 and through the upper crop layer to complete the drying phase of the crop on the upper drying floor. This second drying cycle is typically terminated upon the crop layer on the upper floor attaining a predetermined temperature setpoint. It may be desirable that for this second drying phase that the lower fan/heater is also operated so that a greater volume of heated air may be forced through the upper crop layer. Typically, the setpoint temperature for this second drying phase is somewhat lower than the setpoint temperature for the first drying phase. For example, the setpoint temperature for the second drying phase may be limited to about 130° F. where the temperature for the first drying phase was 140° F.

Upon the completion of the second drying phase on the upper floor, the fan/heaters are mined off and the crop and the crop batch which has been partially dried or cured is gravity dumped from the upper drying floor 13 via openings 19 and dump chutes 25 in the manner heretofore described so that the crop batch initially on the upper drying floor is conveyed to the lower drying floor and such that a substantially uniform depth layer of the crop is formed on the upper surface of the lower sloped drying floor. Of course, leveling bands 51 aid in insuring that a crop layer of uniform depth is formed on the lower drying floor. This transfer step of the crop from the upper to the lower drying floor is illustrated in FIG. *7e*.

As shown in FIG. *7f*, after the first batch has been conveyed to the lower drying floor, a new batch of the crop is loaded onto the upper floor 13. With the partially dried crop batch on the lower drying floor and with the new crop batch on the upper floor, both the upper and lower fan/heaters 59, 61 are started so as to force heated air into both the lower plenum 55 and the upper plenum 61. The setpoint temperature of the fan/heaters is controlled to not exceed a predetermined upper limit (e.g., 140° F.). If the grain temperature rises above a predetermined upper limit (e.g., 140° F.), the fan/heaters may be shut off and a steep cycle may be initiated. Alternatively, the heaters of the fan/heater units may be shut down such that the fans will continue to circulate ambient air through the crop layers.

It will be appreciated that as the crop is dumped from the upper drying floor 13 to the lower drying floor 45 that the crop may have attained its maximum temperature. For example, at the time the crop is so dumped from the upper drying floor, it may have attained a temperature of about 130° F. As air from the lower fan/heater unit 59 is forced through this crop now supported on the lower drying floor, if the temperature of the air from the lower dryer is below the temperature of the grain on the lower floor, the air will pick up heat and moisture from the crop and in this manner, at least some of the heat put into the crop batch while it was undergoing drying on the upper floor is recovered. Simultaneously, the crop on the lower drying floor may undergo a conditioning step to cool the crop and to further lower its moisture content to a desired final state.

Of course, after the drying step as shown in FIG. *7h* is complete, the crop on the lower drying floor 45 may be discharged therefrom, as by opening a slide gate (not shown) on bottom outlet 49 thereby to permit the gravity discharge of the crop from the lower drying floor. As noted, the dried crop may be conveyed from dryer 1 by any number of known conveying systems which do not, per se, constitute a part of this invention.

A tier the lower drying floor 45 has been emptied of dried crop, the crop batch supported on the upper drying floor 13, as shown in FIG. *7h*, may be gravity dumped via openings 19 and chutes 25 onto the now clear lower drying floor in the manner heretofore described. Then, more wet crop to be dried may be loaded into the dryer via the center peak inlet opening 11 so that the dryer is once again configured as shown in FIG. *7e*. Then, the above-described steps may be repeated.

It is believed that the drying apparatus and method of this invention, as heretofore described is substantially more efficient than conventional peanut drying operations utilizing wagons, as described above in the background of the invention. The system of the present invention relates in a faster drying rate, increased energy efficiency, and results in a more uniform moisture content throughout the batch of crops which is done with less horsepower and thus less energy usage.

In view of the above, it will be seen that the several objects and features of this invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. Apparatus for batch drying granular crops in a bin, said crop being capable of flowing by gravity such as corn, beans, rice, wheat, peanuts, milo, or other granular crops, said bin having a bin wall, a bin floor for said bin at the bottom of said bin, a first drying floor mounted within said bin for receiving a batch of said crop to be dried, said first floor being sloped and having a center peak, said first drying floor sloping downwardly from said first drying floor center peak and outwardly toward said bin wall and receiving said crop batch on the upper surface thereof, one or more dump openings around the outer margin of said first drying floor adjacent said wall for the gravity discharge of said crop batch from said first drying floor, means for selectively opening and closing said dump openings, said dump openings when closed holding said crop batch on said first drying floor and when open permitting said crop batch to flow by gravity as a batch from said upper drying floor, a second drying floor positioned within said bin below said first drying floor and above said bin floor, said second drying floor being generally of inverted sloped shape having its outer margin secured to said bin wall below where said outer margin of said first drying floor is attached to said bin wall and having a crop supporting surface sloping downwardly from said bin wall and inwardly toward the bottom of said second floor at the center of said second floor, said second floor having a bottom outlet at the lower center of said second drying floor, said second drying floor being adapted to receive said crop batch discharged from said first drying floor and to hold said crop batch on said crop supporting surface of said second floor as a batch, both said first and second drying floors being of perforate construction for the passage of air therethrough, the space between said bin floor and said second drying floor constituting a first plenum and the space between said first and second drying floors constituting a second plenum, a first fan for introducing air under pressure into said first plenum for forcing air from said first plenum through said second drying floor and through said crop batch supported thereon to at least in part further condition said first crop batch and to discharge said air from said first plenum into said second plenum, a second fan for forcing air into said second plenum such that air within said second plenum is forced upwardly through said first drying floor and through a crop batch on said first drying floor and thence to be discharged from said bin, said second drying floor outlet opening being operable independently of said dump openings for said first drying floor such that the drying profile for the batch of grain on said second drying floor may be different from the drying profile of the grain on said first drying floor.

2. Apparatus as set forth in claim 1 wherein said bin roof has a center opening for the delivery of a batch of said crop to be dried into said bin, said apparatus further comprising means associated with said first drying floor for distributing said crop batch on the upper surface of said first drying floor in a substantially uniform depth upon said crop batch being delivered to said drying floor proximate said center peak of said first drying floor.

3. Apparatus as set forth in claim 1 further comprising means associated with said second drying floor for aiding in distributing said crop batch discharged via said dump openings from said first drying floor onto said second drying floor in a substantially uniform depth.

4. Apparatus as set forth in claim 1 wherein said second fan includes heater means for heating the air forced into said second plenum such that as said heated air from within said second plenum is forced through said crop resting on the upper surface of said first drying floor, moisture from said crop is driven from said crop and is discharged to the ambient air on the exterior of said bin.

5. Apparatus as set forth in claim 4 wherein first fan blows ambient air into said first plenum and through said crop supported on said second drying floor to cool said crop after it has been discharged from said first drying floor and to at least in part recover heat from said crop supported on said second drying floor.

6. Apparatus for batch drying peanuts in the shell, said apparatus comprising a bin having a bin wail, a sloped upper drying floor carded by said bin wall, means for forming a substantially uniform layer of the peanuts to be dried on the upper surface of said upper drying floor, said layer of peanuts supported on the upper surface of said upper drying floor constituting a batch of peanuts to be dried, selectively operable means for effecting the gravity discharge of said batch of peanuts from said upper drying floor, an inverted sloped drying floor carded by said bin below said upper drying floor for receiving said batch of peanuts discharged from said upper drying floor, said lower drying floor having a hopper-shaped crop supporting surface, means associated with said lower drying floor for forming a substantially uniform layer of said batch of peanuts on said lower drying floor upon said batch of peanuts being gravity discharged from said upper drying floor, said lower drying floor having a bottom outlet for the gravity discharge of said peanuts supported thereon, said upper and lower drying floors being of perforate construction so as to permit air under pressure to flow therethrough and through the layer of peanuts supported thereon, a lower plenum within said bin below said lower floor, an upper plenum between said upper and said lower drying floors, a lower fan for forcing air under pressure into said lower plenum so that air from within said lower plenum flows through said perforate lower drying floor and through the peanut layer carded thereby and into said upper plenum, and an upper combination fan and heater for forcing heated air into said upper plenum such that said heated air from said upper combination fan and heater mixes with said air forced through said peanuts on said lower drying floor such that air from both said lower fan and said upper combination fan and heater is forced through said upper drying floor and the layer of peanuts thereon so as to at least in part dry said peanuts on said upper floor.

7. Apparatus for batch drying peanuts as set forth in claim 6 wherein said lower fan includes a heater such that said lower fan may force heated air through said layer of peanuts supported on said lower drying floor.

8. Apparatus as set forth in claim 6 wherein said upper combination fan and heater and said lower fan in cooperating with theft said respective perforate drying floors serve to at least in part fluidize the crop layers supported on said drying floors thereby to aid in the gravity flow of said crop from said drying floors.

9. A method of batch drying a crop in a drying bin having an upper sloped drying floor, a lower inverted sloped drying floor, a lower plenum below said lower drying floor, and an upper plenum between said upper and lower drying floors, said upper and lower drying floors being of perforate construction so as to retain said crop thereon and to permit air under pressure to pass through said floor and into said crop on said drying floor, said upper and lower drying floors having means for the selective gravity, discharge of the batch of grain supported thereon, said method comprising the steps of;

forming a layer of the crop to be dried on the upper surface of said upper drying floor of a substantially uniform depth, said layer forming a crop batch to be dried;

forcing air into said upper plenum, through said upper drying floor, and into and through said crop on said upper drying floor thereby to at least in part dry said crop batch on said upper drying floor;

upon said crop batch on said upper drying floor undergoing sufficient drying, initiating the gravity discharge of said at least partially dried crop batch from said upper drying floor onto said lower drying floor;

forming a substantially uniform layer of said crop batch on said lower drying floor as said crop batch is gravity discharged from said upper drying floor onto said lower drying floor;

forcing air into said lower plenum, through said lower drying floor, and through said crop on said lower drying floor and into said second plenum such that air from within said upper plenum is forced through said upper drying floor and through the crop thereon; and selectively operating said means for effecting gravity discharge of the batch of rain from said lower drying floor so that said crop batch on said lower drying floor may have a different drying profile from the crop batch on said upper drying floor.

10. The method of claim 9 wherein said step of forcing air through drying floors includes so forcing the air through one or more of the drying floors and through the crop layer thereon so as to at least in part fluidize the crop so as to aid in the gravity flow of the crop from the drying floor.

11. The method of claim 9 wherein said step of forcing air into said upper plenum comprises forcing heated air into said upper plenum.

12. The method of claim 11 wherein said step of forcing air into said lower plenum includes recovering heat from said crop batch on said lower floor from when said crop was heated while undergoing said at least partial drying on said upper drying floor.

13. The method of claim 12 further comprising the step of allowing the partially dried crop batch on at least on of said drying floors to steep for a time after the crop batch has been at least partially dried, said steeping being accomplished by terminating the flow of air through said crop batch during at least a part of the steep cycle.

14. A method of batch drying or curing peanuts in the shell in a drying bin having an upper sloped drying floor, a lower plenum below said lower drying floor, and an upper plenum between said upper and lower drying floors, said upper and lower drying floors being of perforate construction so as to retain said crop thereon and to permit air under pressure to pass through said floor and into said crop on said drying floor, said upper and lower drying floors having means for the selective gravity discharge of the batch of grain supported thereon, said method comprising the steps of;

forming a layer of peanuts in the shell to be dried on the upper surface of said upper drying floor of a substantially uniform depth, said layer forming a batch of peanuts to be dried;

forcing air into said upper plenum, through said upper drying floor, and into and through said batch of peanuts on said upper drying floor thereby to at least in part dry said batch on said upper drying floor;

upon said batch on said upper drying floor undergoing sufficient drying, initiating the gravity discharge of said at least partially dried batch from said upper drying floor onto said lower drying floor;

forming a substantially uniform layer of said batch of peanuts on said lower drying floor as said crop batch is gravity discharged from said upper drying floor onto said lower drying floor;

forcing air into said lower plenum, through said lower drying floor, and through said batch of peanuts on said lower drying floor and into said second plenum such that air from within said upper plenum is forced through said upper drying floor and through the peanuts thereon; and effecting operation of said means for effecting gravity discharge of the batch of peanuts from said lower drying floor so that said batch of grain on said lower drying floor may have a different drying profile from the batch of grain on said upper drying floor.

15. The method of claim 14 wherein said step of initiating the gravity discharge of said batch of peanuts from the upper drying floor involves discharging said peanuts from a plurality of discharge openings around the outer margin of said upper drying floor in such manner that upon the gravity discharge of said peanuts via said discharge openings, peanuts from all regions of said layer of peanuts on said upper dryer floor are deposited on the lower drying floor such that upon said peanuts being further conditioned on said lower drying floor and being discharged from said dryer, the batch of peanuts has nearly uniform end conditions.

* * * * *